US005769651A

United States Patent [19]

Omura et al.

[11] Patent Number: 5,769,651

[45] Date of Patent: Jun. 23, 1998

[54] MOVABLE CONNECTOR

[75] Inventors: Naomi Omura; Shinji Kodama, both of Shizuoka, Japan

[73] Assignee: Yazaki Corporation, Tokyo, Japan

[21] Appl. No.: 763,001

[22] Filed: Dec. 10, 1996

[30] Foreign Application Priority Data

Dec. 11, 1995 [JP] Japan ..... 7-321773

[51] Int. Cl.[6] ..... H01R 13/73

[52] U.S. Cl. ..... 439/248

[58] Field of Search ..... 439/247–8, 550, 439/557, 564, 569

[56] References Cited

FOREIGN PATENT DOCUMENTS 5-27814 7/1993 Japan .

*Primary Examiner*—Neil Abrams
*Assistant Examiner*—Eugene G. Byrd
*Attorney, Agent, or Firm*—Morgan, Lewis & Bockius LLP

[57] ABSTRACT

A movable connector provided with a connector housing to be movably attached to an instrument panel. In the movable connector, a pipe portion of an inner flange is slidably fitted to the outside of a flange fitting portion projected from the connector housing in a connector-fitting direction. A flange portion of the inner flange is supported movably along a surface of the instrument panel by an outer flange. A gap between the pipe portion and the outer flange is filled with a first region of an elastic body. Further, a gap between an end surface of the pipe portion and an end surface of the connector housing is filled with a second region of the elastic body. The force acting on the connector housing in a direction perpendicular to the connector-fitting direction is absorbed by elastic deformation of the first region, and the force in the connector-fitting direction is absorbed by elastic deformation of the second region.

5 Claims, 4 Drawing Sheets

MOVABLE CONNECTOR

BACKGROUND OF THE INVENTION

1. Field of the Invention

The present invention relates to a movable connector provided with a connector housing to be movably attached to an attachment subject or an object to which the connector is attached, and more particularly to a movable connector in which either of male and female connectors, for example, used for electric connection between a wire harness in a car and an instrument in an instrument panel is provided as a movable structure for automating the fitting of the connectors so that the displacement between the connectors at the time of fitting of the connectors is absorbed to thereby facilitate the connection between the connectors.

2. Description of the Related Art

As a conventional one, for example, a movable connector disclosed in Japanese Utility Model Examined Publication No. Hei. 5-27814 will be described with reference to FIGS. 6 and 7. The movable connector 11 is configured as a male connector having a plurality of terminal-receiving chambers 16 provided in the inside of a connector housing 12 rectangularly shaped.

Ring-like spring members 17 and substantially rod-like elastic pieces 14 disposed in the spring members 17 respectively are provided on the base end of the connector housing 12 so as to project from the corresponding side wall surfaces of the connector housing 12 respectively. Further, guide flanges 18 projecting from corner portions of the connector housing 12 are provided on the opposite sides of each of the spring members 17.

As shown in FIG. 7, when the spring members 17, the elastic pieces 14 and the guide flanges 18 are fitted into support ditches 20 provided in the circumferential edge of an opening portion 15 of an instrument panel 13, the connector housing 12 is held in the instrument panel 13 and, at the same time, the spring members 17 and the elastic pieces 14 in predetermined positions corresponding to the movement of the connector are elastically deformed so that the connector housing 12 can be moved. Incidentally, each of the width $W_1$ of the spring member 17, the plate thickness $T_1$ of the elastic piece 14 and the plate thickness $T_2$ of the guide flange 18 is selected to be smaller than the ditch width L of the support ditch 20.

The aforementioned respective portions will be described more in detail. The outer diameter of each of the spring members 17 is selected so that the outer circumferential surface of the spring member abuts on the inner bottom surface of the support ditch 20 to thereby urge the connector housing 12 toward the center of the opening portion 15. Each of the elastic pieces 14 is provided to be inclined so that an end of the elastic piece abuts on one inner surface of the support ditch 20 to thereby press the connector housing 12 toward the opposite inner surface side of the support ditch 20.

Further, each of the guide flanges 18 is designed so as to be loosely inserted in the support ditch 20 so that the elastic piece 14 and the spring member 17 never come out from the support ditch 20 when the elastic piece 14 and the spring member 17 are elastically deformed. The size of projection of each of the guide flanges 18 from the connector housing 12 is selected to be smaller than that of the spring member 17.

When the instrument panel 13 is assembled into a car body by an automatic assembling apparatus, the movable connector 11 attached to the instrument panel 13 is fitted into a wire harness side female connector 19 already fixedly provided on the car body by moving the instrument panel 13 in the direction of the arrow ($A_1$) as shown in FIG. 7. Incidentally, taper surfaces 19*b* for introducing the connector housing 12 into a fitting portion 19*a* of the female connector 19 is formed at an opening end of the fitting portion 19*a* of the female connector 19 so that the connector housing 12 is fitted into the fitting portion 19*a*.

The thus configured movable connector 11 is designed so that in the case where there is a relative displacement in axis between the connectors at the time of fitting of the connectors, that is, in the case where the axis $C_1$ of the female connector 19 is displaced (the value of displacement is $L_1$ in FIG. 7) with respect to the axis C of the connector housing 12 in the direction perpendicular to the direction of fitting of the connectors, the displacement can be absorbed by the radially elastic deformation of the spring member 17.

In practice, however, when the axis $C_1$ of the female connector 19 is displaced with respect to the axis C of the connector housing 12 in the direction perpendicular to the direction of fitting of the connectors, there are some cases where the displacement cannot be absorbed smoothly. In the worst case, there is a risk of breaking, or the like, of the connector housing.

This is because, when there is a displacement between the axes C and $C_1$ of the connectors, force F in the direction perpendicular to the axis C acts on an end portion P of the connector housing 12 in an early stage of the fitting of the connectors because of reaction force from the taper surface 19*b*. Accordingly, as shown in FIG. 8, the connector housing 12 partially overcomes the urging force of the elastic piece 14 so as to be rotated in an inclined state in the direction of the arrow ($A_2$), so that pressing force $F_1$ given from the female connector 19 in the direction of fitting of the connectors is concentrated as a bending load into a part (the spring member 17 represented by the arrow ($A_3$) in FIG. 8) of the spring members 17 abutting on a side surface of the support ditches 20.

That is, the original radially elastic deformation characteristic of the spring member 17 is spoiled by the bending load concentrating action, so that the function of moving the connector housing 12 in the direction of absorption of displacement cannot be sufficiently effected. As a result, there is a risk that the connectors 11 and 19 may be broken because of the pressing force acting on the female connector 19.

SUMMARY OF THE INVENTION

Upon such circumstances, an object of the present invention is to provide a movable connector for obtaining good fitting without inclination of a connector housing even in the case where there is a displacement in axis between connectors at the time of fitting of the connectors, that is, to provide a movable connector adapted to automation.

In order to achieve the above object, according to the present invention, there is provided a movable connector provided with a connector housing to be movably attached to an instrument panel, comprising: a flange fitting portion projected from a rear end of the connector housing in a connector-fitting direction; an inner flange including a pipe portion and a flange portion, the pipe portion being fitted to an outside of the flange fitting portion and permitting the connector housing to move within a predetermined range in the connector-fitting direction, and the flange portion being extended from the pipe portion in an outward direction perpendicular to the connector-fitting direction; an outer flange in which the inner flange is loosely inserted, the outer flange being fixed to the instrument panel for slidably nipping the flange portion; and an elastic body including a first region disposed between the inner and outer flanges so that the pipe portion is fitted into the first region, and a second region extended from the first region in the connector-fitting direction so that the flange fitting portion is fitted into the second region.

DETAILED DESCRIPTION OF THE PREFERRED EMBODIMENT

A preferred embodiment of a movable connector according to the present invention will be described below in detail with reference to the drawings.

Figure 1:
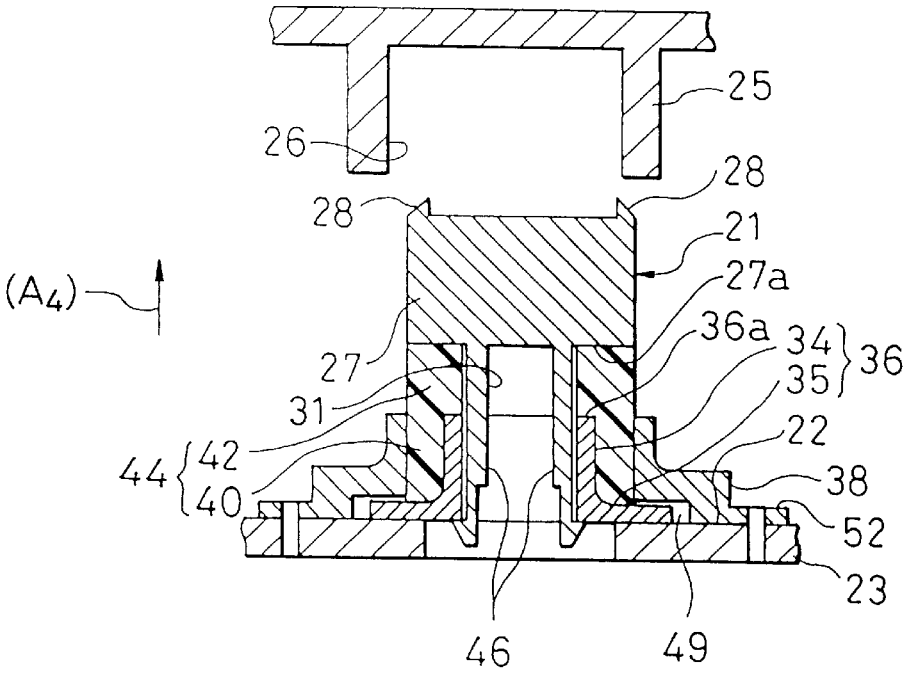
FIG. 1 is a vertical sectional view showing a state in which a movable connector as an embodiment of the present invention is attached to an attachment subject.
Figure 3:
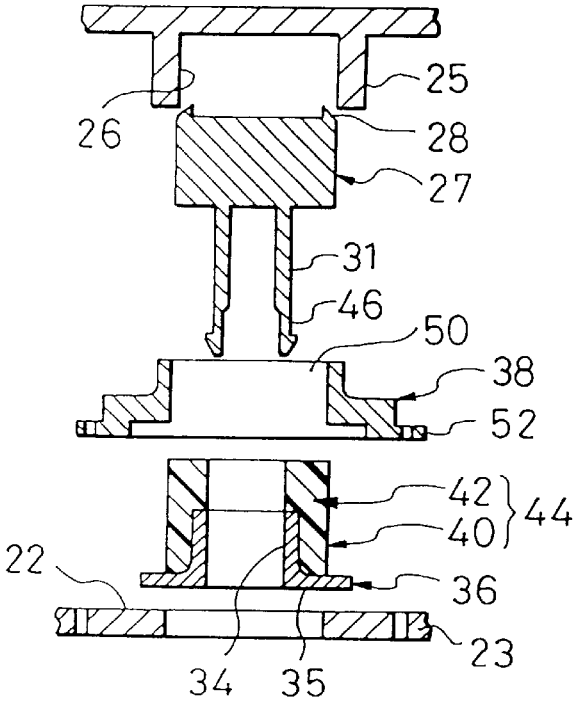
FIG. 3 is an exploded vertical sectional view of the movable connector depicted in FIG. 1.
Figure 2:
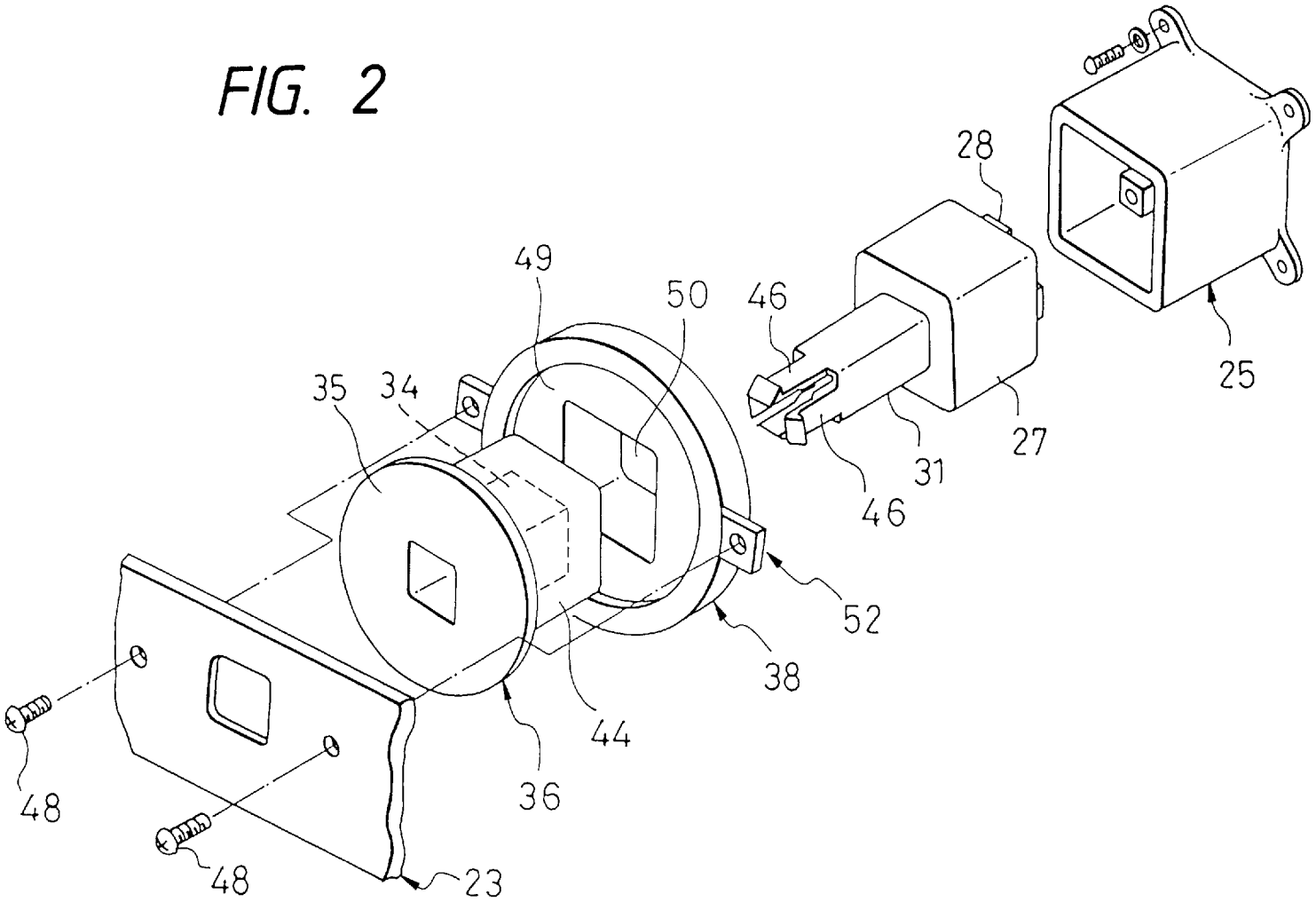
FIG. 2 is an exploded perspective view of the movable connector depicted in FIG. 1.

FIGS. 1 through 3 show an embodiment of the movable connector according to the present invention. FIG. 1 is a vertical sectional view showing a state in which the movable connector is attached to an attachment subject; FIG. 2 is an exploded perspective view of the movable connector; and FIG. 3 is an exploded vertical sectional view of the movable connector.

In this embodiment, the movable connector 21 is formed integrally with instruments or other electric appliances provided on a car instrument panel 23 as an attachment subject and is movably attached to the instrument panel 23 so that the movable connector 21 is provided as a male connector to be connected to a female connector 25 attached to a car body-side wire harness. Taper surfaces 28 are formed in the periphery of a front end of a connector housing 27 of synthetic resin constituting the male connector so as to serve as guide surfaces for fitting the connector housing 27 into a fitting portion 26 of the female connector 25.

The movable connector 21 has a means by which the connector housing 27 is attached to an attachment subject surface 22 on the instrument panel 23 so as to be movable in a predetermined range. This means comprises: a flange fitting portion 31 formed integrally with the connector housing 27; an inner flange 36 fitted to the outside of the flange fitting portion 31; an outer flange 38 through which the inner flange 36 is attached to the attachment subject surface 22; and an elastic body 44 having a first region 40 interposed between the inner flange 36 and the outer flange 38, and a second region 42 interposed between the inner flange 36 and the connector housing 27.

The flange fitting portion 31 is shaped like a quadrilateral pipe which projects from a rear end of the connector housing 27 so as to be extended along a direction of fitting of the male and female connectors 21 and 25 (vertically in FIG. 1). Elastic stoppage pieces 46 for preventing the connector housing 27 from coming off from the inner flange 36 are provided in the front end side of the flange fitting portion 31 correspondingly to the respective sides of the quadrilateral pipe-like flange fitting portion 31.

The inner flange 36 comprises a pipe portion 34 shaped like a quadrilateral pipe in a cross section, being slidably fitted to the outside of the flange fitting portion 31 for limiting the motion of the connector housing 27 in a direction perpendicular to the direction of fitting of the connectors while permitting the connector housing 27 to move within a predetermined range in the direction of fitting of the connectors, and a flange portion 35 extended outward from the base end side of the pipe portion 34 in directions perpendicular to the direction of fitting of the connectors.

The fitting of the pipe portion 34 and the flange fitting portion 31 to each other plays the role of preventing them from rotating relative to each other because they are both quadrilateral.

The outer flange 38 is designed so that the outer flange 38 is fixed to the instrument panel 23 by screw members 48 as shown in FIG. 2 while the inner flange 36 is loosely inserted into the outer flange 38. When the outer flange 38 is fixed to the instrument panel 23, not only the flange portion 35 of the inner flange 36 is received in a recess portion 49 formed in the outer flange 38 but also the flange portion 35 is nipped between the outer flange 38 and the instrument panel 23, thereby making the flange portion 35 movable within a predetermined range only in a direction perpendicular to the direction of fitting of the connectors, that is, in a direction (the right-left direction in FIG. 1) along the attachment subject surface 22 of the instrument panel 23 while bringing the surface of the flange portion 35 into close contact with the attachment subject surface 22.

The first region 40 of the elastic body 44 is disposed so that not only the pipe portion 34 of the inner flange 36 is fitted into the first region 40 but also a gap between the pipe portion 34 and the outer flange 38 is filled with the first region 40. The first region 40 urges the inner flange 36 so that the inner flange 36 is positioned in the center of an allowed movement range.

Not only the second region 42 of the elastic body 44 is extended from the first region 40 in the direction of fitting of connectors so that the flange fitting portion 31 is fitted into the second region 42 but also the second region 42 is disposed so that a gap between an end surface 36*a* of the pipe portion 34 and an end surface 27*a* of the connector housing 27 facing each other is filled with the second region 42, in which pressing force applied to the connector housing 27 in the direction of fitting of the connectors at the time of fitting of the connectors to each other is absorbed by elastic deformation.

The first and second regions 40 and 42 constitute a single elastic body 44 formed by resin molding a sponge member of a soft resin material. Further, in this embodiment, the elastic body 44 is formed integrally with the pipe portion 34 by two-color molding so that the elastic body 44 is shaped substantially like a pipe so as to cover the outer circumference of the pipe portion 34 of the inner flange 36 formed from a hard resin material.

In the movable connector 21 having respective portions configured as described above, in a state in which the pipe portion 34 of the inner flange 36 formed integrally with the elastic body 44 is inserted in a through-hole 50 (see FIGS. 2 and 3) formed in the central portion of the outer flange 38, the flange fitting portion 31 and the elastic stoppage pieces 46 of the connector housing 27 are fitted into the pipe portion 34 to thereby attain integration of the inner and outer flanges 36 and 38 and the connector housing 27. Then, the screw portions 52 of the outer flange 38 are fixed to the instrument panel 23 by screws, by which the connector housing 27 is movably attached to the instrument panel 23.

If the instrument panel 23 is then assembled into a car body provided with the female connector 25 fixed thereto as represented by the arrow ($A_4$) in FIG. 1 while the instrument panel 23 is pushed toward the car body, the movable connector 21 is fitted into the female connector 25.

At the time of fitting of the connectors, the fitting of the flange fitting portion 31 projecting from the connector housing 27 and the inner flange 36 to each other limits the direction of displacement of the connector housing 27 relative to the inner flange 36 only to the direction of fitting of the connectors to thereby prevent the connector housing 27 from being displaced in a direction perpendicular to the direction of fitting of the connectors or from being inclined.

On the other hand, the outer flange 38 which restricts the flange portion 35 of the inner flange 36 onto the attachment subject surface 22, limits the direction of displacement of the inner flange 36 only to a direction along the attachment subject surface 22.

Accordingly, even in the case where force acts in a direction perpendicular to the direction of fitting of the movable connector 21 and the female connector 25 at the time of fitting of the connectors, the posture of attachment is not inclined because the direction of displacement of the connector housing 27 relative to the attachment subject surface 22 is limited to a predetermined direction.

Figure 4:
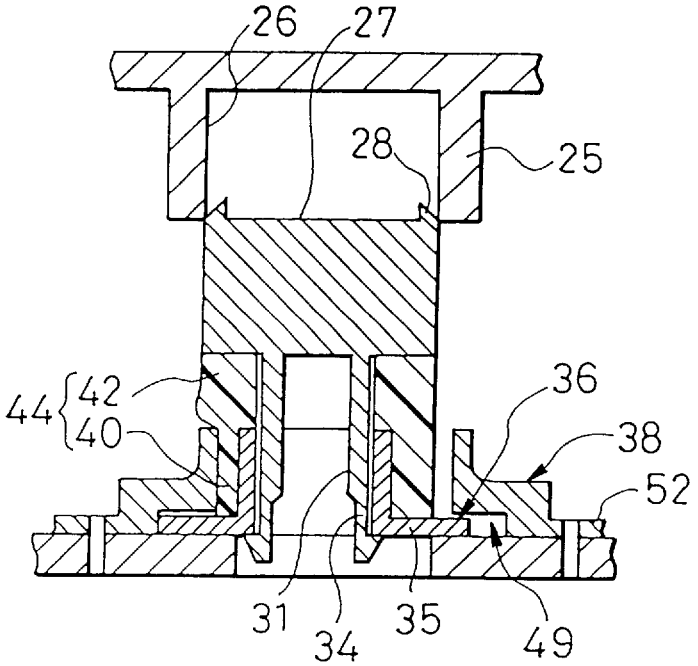
FIG. 4 is a vertical sectional view showing the operation of the movable connector at the time of the start of fitting.

Furthermore, when there is a displacement in axis between the movable connector 21 and the female connector 25 at the time of fitting of the connectors as shown in FIG. 1, the taper surface 28 of the connector housing 27 in the movable connector 21 collides with an end of the fitting portion 26 of the female connector 25 so that force acts in a direction perpendicular to the direction of fitting of the connectors. As shown in FIG. 4, the first region 40 located between the pipe portion 34 and the outer flange 38 is, however, partially elastically deformed to thereby relax a shock due to the force and convert the force into a quantity of displacement along the attachment subject surface 22 rapidly to thereby move the connector housing 27 so that the displacement between the connectors is absorbed.

With respect to pressing force along the direction of fitting of the connectors, as shown in FIG. 4, the second region 42 located between the end surface of the pipe portion 34 of the inner flange 36 and the end surface of the connector housing 27 facing each other is partially elastically deformed to thereby prevent a shock due to the force from occurring.

Figure 5:
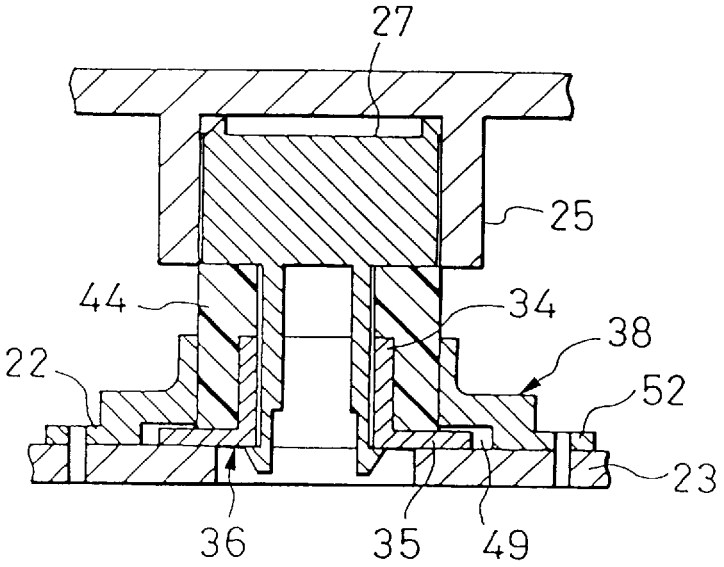
FIG. 5 is a vertical sectional view showing a state in which the fitting of the movable connector is completed.
Figure 6:
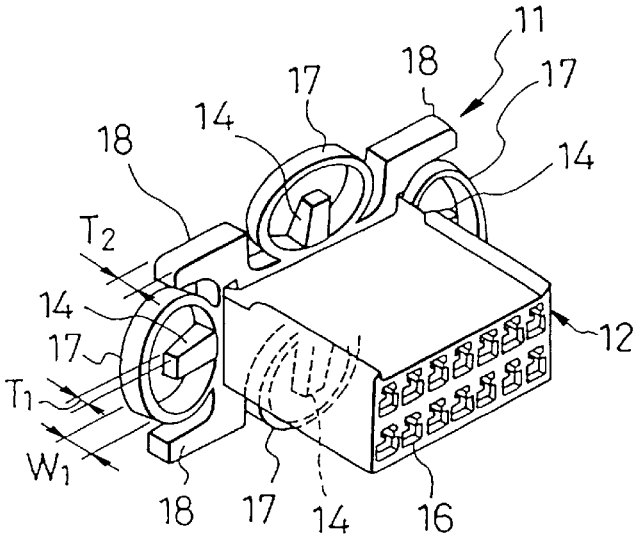
FIG. 6 PRIOR ART
FIG. 6 is a perspective view of a conventional movable connector.
Figure 7:
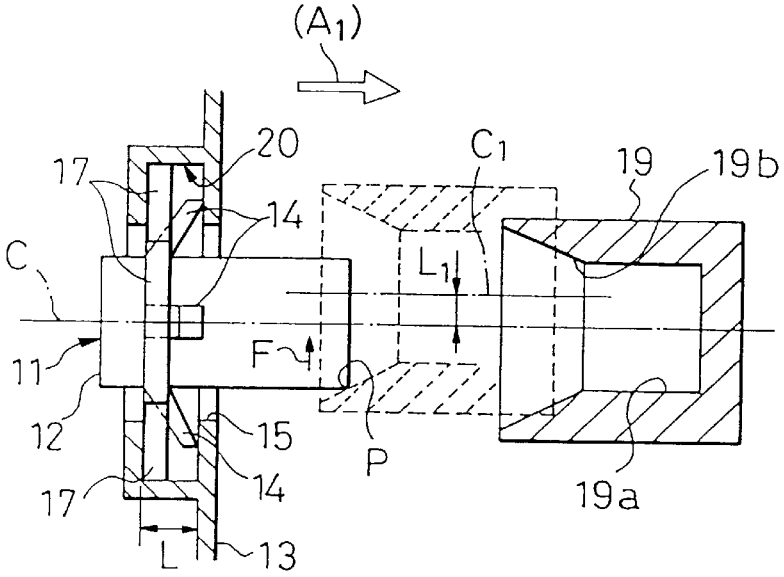
FIG. 7 PRIOR ART
FIG. 7 is a sectional view showing an attachment structure of the movable connector depicted in FIG. 6.
Figure 8:
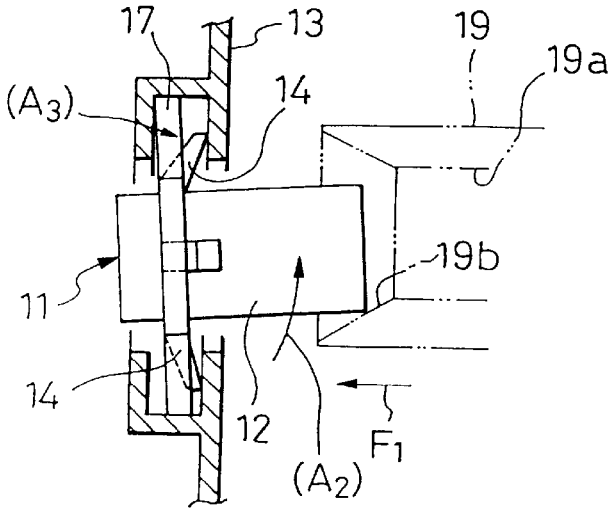
FIG. 8 PRIOR ART
FIG. 8 is a view for explaining a problem in the conventional movable connector.

After the fitting of the connectors is completed as shown in FIG. 5, the instrument panel 23 is attached to the car body side so that the elastic deformation of the first and second regions 40 and 42 is recovered.

Accordingly, even in the case where there is a displacement in axis between the movable connector 21 and the partner connector, not only the displacement can be absorbed without any large shock but also breaking due to the shock at the time of fitting of the connectors can be prevented to thereby achieve smooth and secure fitting.

Further, since the aforementioned embodiment is designed so that the elastic body 44 is formed integrally with the inner flange 36 by two-color molding, the increase in the number of constituent parts is suppressed so that not only the assembling property of the movable connector 21 can be improved but also the reduction of production cost can be attained.

Furthermore, since the aforementioned embodiment is designed so that the pipe portion 34 of the inner flange 36 and the flange fitting portion 31 are shaped quadrilaterally so that the rotation of the connector housing 27 relative to the inner flange 36 is prevented by the fitting of the pipe portion 34 and the flange fitting portion 31, no special rotation stop means is required so that the connector housing 27 and the inner flange 36 can be simplified in structure.

Although the aforementioned embodiment has shown the case where the first and second regions 40 and 42 are provided as an integral construction, the invention is applicable also to the case where these regions 40 and 42 are provided as separate elastic members. Although the aforementioned embodiment has shown the case where the elastic body 44 is formed integrally with the inner flange 36, the invention is applicable also to the case where the elastic body 44 is provided separately from the inner flange 36.

As described above, in the movable connector according to the present invention, since the fitting of the flange fitting portion projecting from the connector housing and the inner flange to each other limits the direction of displacement of the connector housing relative to the inner flange only to the direction of fitting of the connectors, the connector housing is prevented from being displaced in a direction perpendicular to the direction of fitting of the connectors or from being inclined.

Further, the outer flange which restricts the inner flange, limits the direction of displacement of the inner flange only to a direction perpendicular to the direction of fitting of the connectors.

Accordingly, in the movable connector according to the present invention, even in the case where there is a relative displacement in axis between the connectors at the time of fitting of the connectors, the relative displacement between the connectors can be absorbed to make the fitting good since force from the partner connector in a direction perpendicular to the direction of fitting of the connectors is converted into a quantity of displacement along the attachment subject surface so that the connector housing can be moved within a predetermined range. Furthermore, since a large impulsive force generated at the time of fitting of the connectors is also absorbed, the movable connector is adapted to automation.

What is claimed is:

1. A movable connector provided with a connector housing to be movably attached to an instrument panel, comprising:

a flange fitting portion projected from a rear end of said connector housing in a connector-fitting direction;

an inner flange including a pipe portion and a flange portion, said pipe portion being fitted to an outside of said flange fitting portion and permitting said connector housing to move within a predetermined range in the connector-fitting direction, and said flange portion being extended from said pipe portion in an outward direction perpendicular to the connector-fitting direction;

an outer flange in which said inner flange is loosely inserted, said outer flange being fixed to the instrument panel for slidably nipping said flange portion; and an elastic body including a first region disposed between said inner and outer flanges so that said pipe portion is fitted into said first region, and a second region extended from said first region in the connector-fitting direction so that said flange fitting portion is fitted into said second region.

2. The movable connector according to claim 1, wherein said elastic body is formed from a sponge member of a soft resin material so as to be shaped substantially like a pipe to cover an outer circumference of said pipe portion of said inner flange formed from a hard resin material, said elastic body and said inner flange being formed integrally with each other.

3. The movable connector according to claim 1, wherein each of said pipe portion of said inner flange and said flange fitting portion is shaped like a quadrilateral pipe so that rotation of said connector housing relative to said inner flange is prevented by mutual fitting between said pipe portion and said flange fitting portion.

4. The movable connector according to claim 1, wherein said connector housing includes a taper surface formed in a periphery of a front end thereof so as to serve as a guide surface for fitting said connector housing into a fitting portion of a partner connector.

5. The movable connector according to claim 1, wherein said flange fitting portion includes an elastic stoppage piece formed in a front end side thereof for preventing said connector housing from coming off from said inner flange.

* * * * *